US010023930B2

(12) United States Patent
Eguchi et al.

(10) Patent No.: US 10,023,930 B2
(45) **Date of Patent: *Jul. 17, 2018**

(54) METHOD OF MANUFACTURING HIGH STRENGTH STAINLESS STEEL TUBE OR PIPE

(71) Applicant: JFE Steel Corporation, Tokyo (JP)

(72) Inventors: Kenichiro Eguchi, Chita (JP); Yasuhide Ishiguro, Chita (JP)

(73) Assignee: JFE Steel Corporation (JP)

( * ) Notice: Subject to any disclaimer, the term of this patent is extended or adjusted under 35 U.S.C. 154(b) by 40 days.

This patent is subject to a terminal disclaimer.

(21) Appl. No.: 14/651,299

(22) PCT Filed: Dec. 11, 2013

(86) PCT No.: PCT/JP2013/007285

§ 371 (c)(1),
(2) Date: Jun. 11, 2015

(87) PCT Pub. No.: WO2014/091756

PCT Pub. Date: Jun. 19, 2014

(65) Prior Publication Data

US 2015/0315667 A1 Nov. 5, 2015

(30) Foreign Application Priority Data

Dec. 12, 2012 (JP) ..... 2012-271180

(51) Int. Cl.

| | |
|---|---|
| ***C21D 1/25*** | (2006.01) |
| ***C21D 9/08*** | (2006.01) |
| ***C21D 9/00*** | (2006.01) |
| ***C22C 38/02*** | (2006.01) |
| ***C22C 38/04*** | (2006.01) |
| ***C22C 38/00*** | (2006.01) |
| ***C22C 38/06*** | (2006.01) |
| ***C22C 38/50*** | (2006.01) |
| ***C22C 38/48*** | (2006.01) |
| ***C22C 38/46*** | (2006.01) |
| ***C22C 38/42*** | (2006.01) |
| ***C22C 38/24*** | (2006.01) |
| ***C22C 38/58*** | (2006.01) |
| ***C22C 38/40*** | (2006.01) |
| ***C22C 38/44*** | (2006.01) |

(52) U.S. Cl.

CPC ..... *C21D 9/085* (2013.01); *C21D 1/25* (2013.01); *C21D 9/0062* (2013.01); *C21D 9/08* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/24* (2013.01); *C22C 38/40* (2013.01); *C22C 38/42* (2013.01); *C22C 38/44* (2013.01); *C22C 38/46* (2013.01); *C22C 38/48* (2013.01); *C22C 38/50* (2013.01); *C22C 38/58* (2013.01)

(58) Field of Classification Search

CPC ..... C21D 9/085; C21D 9/0062
USPC ..... 148/592
See application file for complete search history.

(56) References Cited

U.S. PATENT DOCUMENTS

| | | | | |
|---|---|---|---|---|
| 9,234,254 | B2 * | 1/2016 | Eguchi et al. | 148/500 |
| 2003/0192624 | A1 * | 10/2003 | Siebert | 148/251 |
| 2006/0243354 | A1 | 11/2006 | Kimura et al. | |
| 2007/0074793 | A1 | 4/2007 | Kimura et al. | |
| 2009/0272469 | A1 | 11/2009 | Kimura et al. | |
| 2010/0193087 | A1 | 8/2010 | Miyata et al. | |
| 2012/0186704 | A1 * | 7/2012 | Eguchi et al. | 148/500 |
| 2013/0180628 | A1 | 7/2013 | Chabot et al. | |

FOREIGN PATENT DOCUMENTS

| | | | |
|---|---|---|---|
| CN | 1836056 | A * | 9/2006 |
| CN | 101348849 | | 1/2009 |
| JP | 8-188827 | | 7/1996 |
| JP | 2002-30342 | | 1/2002 |
| JP | 2005-34517 | | 2/2005 |
| JP | 2005-105357 | | 4/2005 |
| JP | 2005-336595 | | 12/2005 |
| JP | 2009-7658 | | 1/2009 |
| WO | 2012/035240 | | 3/2012 |

OTHER PUBLICATIONS

Supplementary European Search Report dated Nov. 26, 2015 of corresponding European Application No. 13862381.4.
Chinese Office Action dated Jan. 28, 2016 of corresponding Chinese Application No. 201380064750.9 along with an English translation of the Search Report.
Zhu, X., *Steel Testing Manual*, China Standards Press, p. 46, 2009, ISBN: 978-7-5066-5374-9, along with English abstract.

* cited by examiner

*Primary Examiner* — Edward Johnson
(74) *Attorney, Agent, or Firm* — DLA Piper LLP (US)

(57) ABSTRACT

A method of manufacturing a high strength stainless steel tube or pipe includes using an online heat treatment equipment line for a seamless steel tube or pipe in which a heating furnace for quenching, equipment for quenching, and a tempering furnace are used in the lower process of a rolling line, arranging cooling facilities capable of cooling a heat treated steel tube or pipe to a temperature of 20° C. or lower between the equipment for quenching and the tempering furnace, and cooling the heat treated steel tube or pipe to a temperature of 20° C. or lower before a tempering treatment is performed.

3 Claims, 1 Drawing Sheet

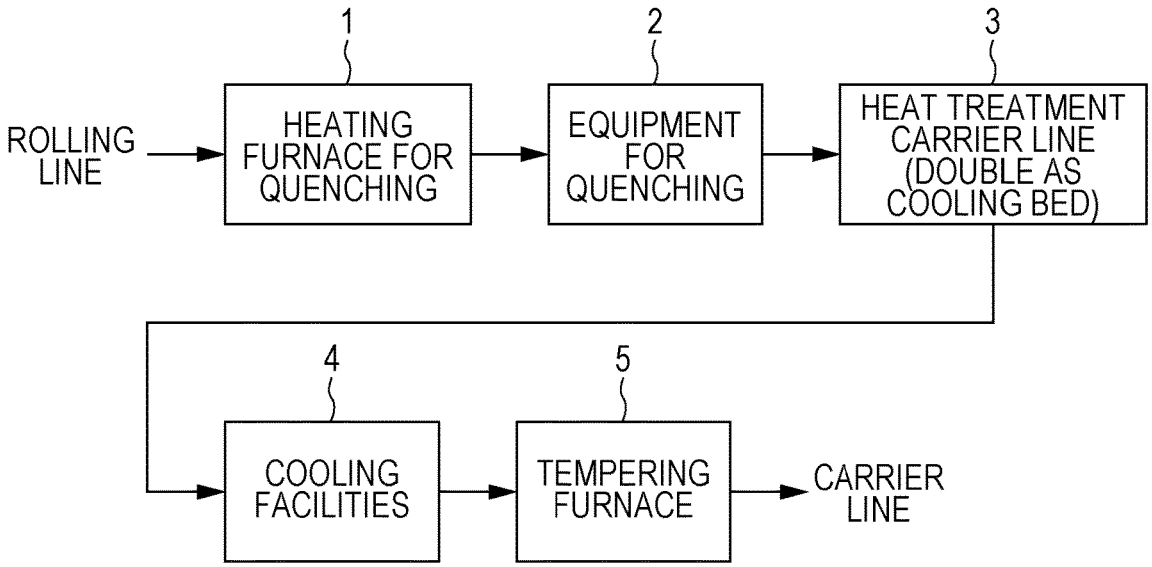
1
2
3
ROLLING LINE
HEATING FURNACE FOR QUENCHING
EQUIPMENT FOR QUENCHING
HEAT TREATMENT CARRIER LINE (DOUBLE AS COOLING BED)
4
5
COOLING FACILITIES
TEMPERING FURNACE
CARRIER LINE

METHOD OF MANUFACTURING HIGH STRENGTH STAINLESS STEEL TUBE OR PIPE

TECHNICAL FIELD

This disclosure relates to a method of manufacturing a high strength stainless steel tube or pipe and a heat treatment equipment line for a high strength stainless steel tube or pipe to give stable product quality to a high Cr seamless steel tube or pipe which is subjected to a quenching and tempering treatment.

BACKGROUND

Conventionally, heat treatments such as quenching, tempering, annealing, and a solution heat treatment are used as heat treatments for a steel tube or pipe. Those heat treatments are being performed selectively in accordance with a purpose such as performance required by customers or homogenization of product quality.

Generally, the heat treatments for a seamless steel tube or pipe are performed online from the viewpoint of productivity. For example, in Japanese Unexamined Patent Application Publication No. 2002-30342, a heat treatment equipment line in which a heating furnace for quenching, equipment for quenching, and a tempering furnace are effectively arranged is proposed to enhance efficiency and compactness.

Nowadays, on the other hand, the environment of usage of seamless steel tubes or pipes for Oil Country Tubular Goods, which are used in oil wells and gas wells for crude oil and natural gas, is becoming harsher than ever, the tubes or pipes are required to have not only high strength but also high performance including high corrosion resistance. In view of such a situation, for example, a high strength stainless steel tube or pipe for Oil Country Tubular Goods containing 15.5% (mass %, simply represented by % hereinafter) or more of Cr and having a strength higher than 654 MPa (95 ksi) in terms of yield strength, excellent $CO_2$ corrosion resistance, and high toughness, which is disclosed in Japanese Unexamined Patent Application Publication No. 2005-336595, has been developed and used.

However, in a high strength stainless steel tube or pipe containing a large amount of Cr as described above and which contains alloy chemical elements such as Ni and Mo, the martensite transformation finish temperature (Mf point) is about room temperature or equal to or lower than room temperature (25° C.). When a quenching and tempering treatment is performed on that high strength stainless steel tube or pipe using conventional heat treatment equipment, since a cooling stop temperature after quenching varies due to a change in room temperature and constraints because of processes in a continuous operation, there is a variation in the volume fraction of a residual austenite phase before tempering is performed. Therefore, there is a problem in that, since mechanical properties such as strength and toughness become unstable after a heat treatment has been performed, these mechanical properties vary among products.

It could therefore be helpful to provide a heat treatment equipment line for a seamless steel tube or pipe, and a method of manufacturing a high strength stainless steel tube or pipe with which stable product quality can be obtained after a heat treatment has been performed.

SUMMARY

We thus provide:

(1) A method of manufacturing a high strength stainless steel tube or pipe, the method including using an online heat treatment equipment line for a seamless steel tube or pipe in which a heating furnace for quenching, equipment for quenching, and a tempering furnace are used in the lower process of a rolling line, arranging cooling facilities which are capable of cooling a heat treated steel tube or pipe to a temperature of 20° C. or lower between the equipment for quenching and the tempering furnace, and cooling the heat treated steel tube or pipe to a temperature of 20° C. or lower before a tempering treatment is performed.

(2) The method of manufacturing a high strength stainless steel tube or pipe according to item (1), in which the high strength stainless steel tube or pipe has a chemical composition containing, by mass %, C: 0.005% or more and 0.05% or less, Si: 0.05% or more and 1.0% or less, Mn: 0.2% or more and 1.8% or less, P: 0.03% or less, S: 0.005% or less, Cr: 14% or more and 20% or less, Ni: 1.5% or more and 10% or less, Mo: 1% or more and 5% or less, N: 0.15% or less, O: 0.006% or less, and the balance being Fe and inevitable impurities, in which the high strength stainless tube or steel pipe is reheated at a temperature of 850° C. or higher and 1000° C. or lower using the heating furnace for quenching, in which the reheated tube or pipe is cooled to a temperature of 50° C. or lower at a cooling rate equal to or more than an air cooling rate using the equipment for quenching, in which the tube or pipe is subsequently cooled to a temperature of 20° C. or lower using the cooling facilities, and in which the cooled tube or pipe is heated at a temperature of 450° C. or higher and 700° C. or lower using the tempering furnace.

(3) The method of manufacturing a high strength stainless steel tube or pipe according to item (2), in which the high strength stainless steel tube or pipe has the chemical composition further containing, by mass %, one or more selected from among Al: 0.002% or more and 0.05% or less, Cu: 3.5% or less, Nb: 0.5% or less, V; 0.5% or less, Ti: 0.3% or less, Zr: 0.2% or less, W: 3% or less, B: 0.01% or less, Ca: 0.01% or less, and REM: 0.1% or less.

(4) A heat treatment equipment line that manufactures a high strength stainless steel tube or pipe, the heat treatment equipment line being an online heat treatment equipment line for a seamless steel tube or pipe including a heating furnace for quenching, equipment for quenching, and a tempering furnace which are used in the lower process of a rolling line, in which cooling facilities which are capable of cooling a heat treated steel tube or pipe to a temperature of 20° C. or lower are arranged on one of ends or a portion of a heat treatment carrier line which is arranged between the equipment for quenching and the tempering furnace.

(5) The method of manufacturing a high strength stainless steel pipe according to any one of items (1) to (3), in which the cooling facilities are capable of cooling a heat treated steel tube or pipe to a temperature of 10° C. or lower, and in which the heat treated steel tube or pipe is cooled to a temperature of 10° C. or lower before a tempering treatment is performed.

(6) The heat treatment equipment line of manufacturing the high strength stainless steel tube or pipe according to item (4), in which the cooling facilities are capable of cooling a heat treated steel tube or pipe to a temperature of 10° C. or lower.

Thus, in a quenching and tempering treatment for a seamless steel tube or pipe, a cooling stop temperature in a quenching treatment becomes 20° C. or lower, or preferably 10° C. or lower, and definite. Therefore, since the volume fraction of a residual austenite phase becomes definite before a tempering treatment is performed even when a high strength stainless steel tube or pipe which contains 14% or more of Cr and which contains alloy chemical elements such as Ni and Mo is manufactured, stable product quality can be obtained.

BRIEF DESCRIPTION OF THE DRAWING

FIG. 1 is a schematic diagram illustrating one example of the heat treatment equipment line for a seamless steel tube or pipe.

REFERENCE SIGNS LIST

1 heating furnace for quenching
2 equipment for quenching
3 heat treatment carrier line (double as cooling bed)
4 cooling facilities
5 tempering furnace

DETAILED DESCRIPTION

In a conventional heat treatment equipment line, after a steel tube or pipe has been heated and held at a specified temperature in a heating furnace that quenches, the steel tube or pipe is cooled using a water quenching method, an air blast cooling method, or an air cooling method, and then tempering is performed by heating and holding the steel tube or pipe at a specified temperature. Here, a cooling stop temperature after quenching has been performed is, for example, 100° C. or lower or equal to room temperature as described, for example, in Japanese Unexamined Patent Application Publication No. 2005-336595. In high-alloy steel which contains a large amount of alloy chemical elements such as Cr and Ni, since a martensite transformation finish temperature (Mf point) may be 20° C. or lower, the volume fraction of a residual austenite phase varies in accordance with a cooling stop temperature, which results in a variation in product quality after tempering has been performed.

Therefore, we studied equipment with which this cooling stop temperature becomes equal to or lower than room temperature and always definite, and as a result, as illustrated in FIG. 1, discovered a heat treatment equipment line in which a cooling facilities 4 capable of always cooling a heat treated steel tube or pipe to a definite temperature (20° C. or lower, or preferably 10° C. or lower) using water as a cooling medium is arranged between equipment for quenching 2 and a tempering furnace 5. The cooling facilities 4 arranged at the end on the downstream side of a heat treatment carrier line 3 in FIG. 1 may be arranged in the middle of the heat treatment carrier line 3 or at the end on the upstream side of the heat treatment carrier line 3.

The water which has been used as a cooling medium circulates between the cooling facilities 4 and a refrigerator for a cooling medium (not illustrated) while the temperature of the water is continuously detected. The circulating water always has a definite temperature by being cooled by the refrigerator for a cooling medium. "Always definite" refers to when the temperature of the cooling medium is always definite when the cooling medium is fed into the cooling facilities 4 from the refrigerator for a cooling medium. In addition, "definite" refers to when a temperature is within a range of a specified temperature±3.0° C.

Subsequently, the reasons for limitations on the chemical composition of the high strength stainless steel tube or pipe will be described. Hereinafter, "%" used when describing a chemical composition represents "mass %"

C: 0.005% or More and 0.05% or Less

C is an important chemical element relevant to the corrosion resistance and strength of martensite stainless steel. It is preferable that the C content be 0.005% or more. When the C content is more than 0.05%, since an excessive amount of Cr carbide is formed, there may be a decrease in the amount of solid solute Cr, which is effective for corrosion resistance. To prevent this phenomenon, it is preferable that the C content be in a range of 0.005% or more and 0.05% or less. In addition, it is preferable that the C content be as small as possible from the viewpoint of corrosion resistance. In addition, it is preferable that the C content be large to achieve sufficient strength. In consideration of the balance between both properties, it is more preferable that the C content be 0.005% or more and 0.03% or less.

Si: 0.05% or More and 1.0% or Less

Si is a chemical element which functions as a deoxidizing agent. It is preferable that the Si content be 0.05% or more. In addition, when the Si content is more than 1.0%, there is a deterioration in $CO_2$ corrosion resistance, and there may also be a deterioration in hot workability. Therefore, it is preferable that the Si content be 0.05% or more and 1.0% or less, or more preferably 0.10% or more and 0.3% or less.

Mn: 0.2% or More and 1.8% or Less

Mn is a chemical element which increases strength. It is preferable that the Mn content be 0.2% or more to achieve the desired strength. When the Mn content is more than 1.8%, there may be a negative effect on toughness. Therefore, it is preferable that the Mn content be 0.2% or more and 1.8% or less, or more preferably 0.2% or more and 0.8% or less.

P: 0.03% or Less

P is a chemical element which deteriorates both corrosion resistance and sulfide stress corrosion cracking resistance. It is preferable that the P content be as small as possible. However, an excessive decrease in P content causes an increase in manufacturing cost. To prevent a deterioration in both corrosion resistance and sulfide stress corrosion cracking resistance within a range industrially realizable at comparatively low cost, it is preferable that the P content be 0.03% or less, or more preferably 0.02% or less.

S: 0.005% or Less

S is a chemical element which significantly deteriorates hot workability in a pipe manufacturing process. It is preferable that the S content be as small as possible. Since it is possible to manufacture a steel tube or pipe using a common process when the S content is decreased to 0.005% or less, it is preferable that the S content be 0.005% or less, or more preferably 0.002% or less.

Cr: 14% or More and 20% or Less

Cr is a chemical element which enhances corrosion resistance by forming a protective surface film on a steel tube or pipe and which, in particular, contributes to an increase in $CO_2$ corrosion resistance and sulfide stress corrosion cracking resistance. It is preferable that the Cr content be 14% or more from the viewpoint of corrosion resistance. Since there is an excessive increase in the volume fractions of an austenite phase and a ferrite phase when the Cr content is more than 20%, the desired high strength cannot be achieved, and there is a deterioration in toughness and hot workability. It is more preferable that the Cr content be 15% or more and 18% or less.

Ni: 1.5% or More and 10% or Less

Ni has a function for enhancing $CO_2$ corrosion resistance, pitting corrosion resistance, and sulfide stress corrosion cracking resistance by strengthening a protective surface film. Moreover, Ni is a chemical element which increases the strength of steel through solid solution strengthening. Such effects are recognized when the Ni content is 1.5% or more. However, when the Ni content is more than 10%, the desired high strength cannot be achieved, and there may also be a deterioration in hot workability. It is more preferable that the Ni content be 3% or more and 8% or less.

Mo: 1% or More and 5% or Less

Mo is a chemical element which enhances resistance to pitting corrosion caused by $Cl^-$. It is preferable that the Mo content be 1% or more. When the Mo content is more than 5%, since there is an excessive increase in the amounts of an austenite phase and a ferrite phase, the desired high strength cannot be achieved, and there may also be a deterioration in toughness and hot workability. In addition, when the Mo content is more than 5%, since intermetallics are precipitated, there may be a deterioration in toughness and sulfide stress corrosion cracking resistance. It is more preferable that the Mo content be 2% or more and 4% or less.

N: 0.15% or Less

N is a chemical element which significantly enhances pitting corrosion resistance. When the N content is more than 0.15%, since various kinds of nitrides are formed, there may be a deterioration in toughness due to formation of such nitrides. Therefore, it is preferable that the Ni content be 0.15% or less, or more preferably 0.1% or less.

O: 0.006% or less

O has a negative effect on various properties as a result of being present in the form of oxides in steel. It is preferable that the O content be as small as possible to improve the properties. In particular, when the O content is more than 0.006%, there is a significant deterioration in hot workability, corrosion resistance, sulfide stress corrosion cracking resistance, and toughness. Therefore, it is preferable that the O content be 0.006% or less.

In addition to the basic chemical composition described above, one or more selected from among Al: 0.002% or more and 0.05% or less, Cu: 3.5% or less, Nb: 0.5% or less, V; 0.5% or less, Ti: 0.3% or less, Zr: 0.2% or less, W: 3% or less, B: 0.01% or less, Ca: 0.01% or less, and REM: 0.1% or less may be further added.

Al is a chemical element which has strong deoxidizing action. It is preferable that the Al content be 0.002% or more to realize this effect. When the Al content is more than 0.05%, there may be a negative effect on toughness. Therefore, when Al is added, it is preferable that the Al content be 0.002% or more and 0.05% or less, or more preferably 0.03% or less. When Al is not added, Al may be contained in an amount of less than about 0.002% as an inevitable impurity. There is the advantage that there is a significant enhancement in low-temperature toughness when the Al content is less than about 0.002%.

Cu is a chemical element which enhances sulfide stress corrosion cracking resistance by preventing hydrogen from intruding into steel as a result of strengthening a protective surface film. This effect becomes noticeable when the Cu content is 0.5% or more. In addition, when the Cu content is more than 3.5%, since CuS is precipitated in grain boundary, there is a deterioration in hot workability. Therefore, it is preferable that the Cu content be 3.5% or less. It is more preferable that the Cu content be 1.0% or more and 3.0% or less.

Nb, V, Ti, Zr, W, and B are all chemical elements which increase strength, and these chemical elements are added as needed. Also, V, Ti, Zr, W, and B are chemical elements which improve stress corrosion cracking resistance. Such effects become noticeable when the Nb content is 0.03% or more, the V content is 0.02% or more, the Ti content is 0.03% or more, the Zr content is 0.03% or more, the W content is 0.2% or more or the B content is 0.0005% or more. On the other hand, there is a deterioration in toughness and hot workability when the Nb content is more than 0.5%, the V content is more than 0.5%, the Ti content is more than 0.3%, the Zr content is more than 0.2%, the W content is more than 3% or the B content is more than 0.01%. Therefore, it is preferable that the Nb content be 0.5% or less, the V content be 0.5% or less, the Ti content be 0.3% or less, the Zr content be 0.2% or less, the W content be 3% or less, and the B content be 0.01 or less.

Ca has a function of spheroidizing sulfide-based inclusions by fixing S in the form of CaS. With this function, the hydrogen trapping ability of inclusions is deteriorated by decreasing the lattice strain of a matrix surrounding the inclusions. Such an effect is noticeable when the Ca content is 0.0005% or more. In addition, when the Ca content is more than 0.01%, since there is an increase in the amount of CaO, there is a deterioration in corrosion resistance. Therefore, it is preferable that the Ca content be 0.01% or less.

REM enhances stress corrosion cracking resistance in an environment of an aqueous chloride solution having a high temperature. Such an effect becomes noticeable when the REM content is 0.001% or more. On the other hand, when the REM content is excessively large, the effect becomes saturated. Therefore, it is preferable that the upper limit of the REM content be 0.1%. It is more preferable that the REM content be 0.001% or more and 0.01% or less. "REM" refers to yttrium (Y) having an atomic number of 39 and lanthanoid elements having an atomic number of 57 (lanthanum (La)) to 71 (lutetium (Lu)). It is preferable that the stainless steel contain one, or more of the REM mentioned above. The REM content refers to the total content of one, or more selected from among the plural kinds of REM mentioned above.

The remainder of the chemical composition other than chemical constituents described above consists of Fe and inevitable impurities.

Subsequently, the method of manufacturing the steel tube or pipe will be described.

First, it is preferable that molten steel having the chemical composition described above be manufactured using a commonly well-known manufacturing method such as one using a steel converter furnace, an electric furnace, or a vacuum melting furnace, and that the molten steel be made into a steel tube or pipe material such as a billet using a commonly well-known method such as a continuous casting method or a slabbing mill method for rolling an ingot. Subsequently, such a steel tube or pipe material is made into a seamless steel tube or pipe having a desired size by heating the steel tube or pipe material, by performing hot rolling on the heated material and forming it into a tube or pipe in a manufacturing process using a common Mannesmann-plug mill method or a Mannesmann-mandrel mill method. After the tube or pipe has been formed, it is preferable that the seamless steel tube or pipe be cooled to room temperature at a cooling rate more than that of air cooling. Also, a seamless steel tube or pipe may be manufactured by performing hot extrusion using a press method. The hot rolling or hot extrusion mentioned above corresponds to a treatment in the rolling line in FIG. 1.

Subsequently, the seamless steel tube or pipe described above is heated again at a temperature of 850° C. or higher and 1100° C. or lower using a heating furnace for quenching 1. Then, the heated steel tube or pipe is cooled to a temperature of 50° C. or lower at a cooling rate equal to or more than that of air cooling using equipment for quenching 2. In the heat treatment equipment line illustrated in FIG. 1, subsequently, the seamless steel tube or pipe which has been cooled using the equipment for quenching 2 runs through a heat treatment carrier line 3 (even if the temperature of the seamless steel tube or pipe which has been cooled using the equipment for quenching 2 is higher than 50° C., it is appropriate that the steel tube or pipe be cooled to a temperature of 50° C. or lower as a result of running through the heat treatment carrier line 3). Further, the seamless steel tube or pipe is cooled to a temperature of 20° C. or lower using the cooling facilities 4 arranged at the end on the downstream side of the heat treatment carrier line 3. As described above, it is preferable that a quenching treatment be performed using the heating furnace for quenching 1 through to the cooling facilities 4. The seamless steel tube or pipe cooled using the cooling facilities 4 is subjected to a tempering treatment using a tempering furnace 5, and the tempered seamless steel tube or pipe is carried further to a downstream carrier line. The position where the cooling facilities 4 are arranged may be one of ends or a portion of the heat treatment carrier line 3 arranged between the equipment for quenching 2 and the tempering furnace 5.

Using the manufacturing described above, the steel microstructure of a seamless steel tube pipe can be controlled to be a martensite phase having a fine grain diameter and high toughness. In addition, the steel microstructure may include an appropriate amount of other phases such as a ferrite phase and a residual austenite phase. It is preferable that the total amount of such other phases included be 20 vol % or less. In addition, the microstructure may be a martensite+ferrite phase. It is preferable that the amount of a residual austenite phase be 10 vol % or less.

The reasons for the limitations on and preferable ranges of the heating temperature and other conditions will be described hereafter.

When the heating temperature for quenching in the heating furnace for quenching 1 is lower than 850° C., since a sufficient quenching treatment cannot be applied to a martensite portion, there is a tendency for strength to decrease. In addition, when the heating temperature for quenching is higher than 1100° C., since there is an excessive increase in the grain diameter of a microstructure, there is a deterioration in toughness. Therefore, it is preferable that the heating temperature in the heating furnace for quenching 1 be 850° C. or higher and 1100° C. or lower.

When the cooling stop temperature (the temperature of the seamless steel tube or pipe which has been cooled using the cooling facilities 4) after the quenching has been performed is room temperature, the volume fraction of a residual austenite phase may vary due to a variation in room temperature, which results in variations in mechanical properties. Therefore, it is preferable that the cooling stop temperature mentioned above be 20° C. or lower, or more preferably 10° C. or lower.

In particular, using the cooling facilities 4, it is possible to control the cooling stop temperature to be equal to or lower than room temperature and to be always definite. Therefore, when plural seamless steel tubes or pipes are manufactured, it is possible to significantly reduce variations in the mechanical properties of the seamless steel tubes or pipes.

It is preferable that the seamless steel tube or pipe which has been subjected to a quenching treatment be subjected to a tempering treatment in which the steel tube or pipe is heated to a temperature of 450° C. or higher and 700° C. or lower using the tempering furnace 5 and in which the heated steel tube or pipe is cooled at a cooling rate equal to or more than that of air cooling. As a result of the seamless steel tube or pipe being heated and subjected to a tempering treatment in the temperature range mentioned above, the microstructure of the steel becomes a microstructure which is composed of a tempered martensite phase, which is composed of a tempered martensite phase, a small amount of ferrite phase, and a small amount of residual austenite phase, or which is composed of a tempered martensite phase, a ferrite phase, and a small amount of residual austenite phase. As a result, the seamless steel tube or pipe has not only the desired high strength but also the desired high toughness and the desired excellent corrosion resistance.

Examples

The steel tube or pipe materials having the chemical compositions given in Table 1 were made into tubes or pipes by performing hot working, and then the obtained tubes or pipes were cooled by air to manufacture seamless steel tubes or pipes having an outer diameter of 83.8 mm and a thickness of 12.7 mm. The obtained seamless steel tubes or pipes were subjected to a quenching treatment in which the tubes or pipes were respectively heated at the temperatures given in Table 2 and then the heated tubes or pipes were cooled by air or water to room temperature (the conventional example and the comparative examples), and after the quenching treatment mentioned above had been performed, some seamless steel tubes or pipes were subjected to a treatment in which the tubes or pipes were cooled to a temperature of 10° C. using our cooling facilities (the examples). In our examples, the temperatures of the seamless steel tubes or pipes before the tubes or pipes were carried into the cooling facilities are given in Table 2 (the cooling stop temperatures of a quenching treatment in Table 2). Subsequently, the tubes or pipes were respectively subjected to a tempering treatment at the temperatures given in Table 2. Using a test piece which was collected from each of the steel tubes pipes which had been subjected to the tempering treatment, a residual austenite fraction and tensile properties were investigated. The results are given in Table 2. A residual austenite fraction was determined through the conversion from an X-ray diffraction integrated intensity determined using an X-ray diffraction method. In addition, to evaluate variation, one evaluation test was performed using 10 samples for each steel tube or pipe code. A variation was defined as the difference between the maximum YS and the minimum YS.

TABLE 1

| Steel Code | C | Si | Mn | P | S | Cr | Ni | Mo | N | O | Al | Cu | Nb, V, Ti, Zr, W, B | Ca, REM | Ms | Note |
|---|---|---|---|---|---|---|---|---|---|---|---|---|---|---|---|---|
| A | 0.19 | 0.25 | 0.44 | 0.015 | 0.002 | 12.4 | — | — | 0.020 | 0.005 | — | — | V: 0.05 | — | 345 | Conventional Example |
| B | 0.02 | 0.34 | 0.54 | 0.017 | 0.001 | 16.2 | 6.1 | 2.7 | 0.019 | 0.003 | 0.055 | 2.1 | V: 0.08 | REM: 0.002 | 15 | Example |
| C | 0.02 | 0.28 | 0.84 | 0.010 | 0.001 | 15.0 | 4.9 | 2.6 | 0.040 | 0.005 | 0.025 | 2.7 | V: 0.07 Ti: 0.008 | — | 75 | Example |

TABLE 1-continued

| Steel Code | C | Si | Mn | P | S | Cr | Ni | Mo | N | O | Al | Cu | Nb, V, Ti, Zr, W, B | Ca, REM | Ms | Note |
|---|---|---|---|---|---|---|---|---|---|---|---|---|---|---|---|---|
| D | 0.02 | 0.18 | 0.29 | 0.020 | 0.001 | 17.5 | 2.7 | 2.6 | 0.031 | 0.004 | 0.010 | 0.2 | Nb: 0.08 V: 0.06 | — | 90 | Example |

TABLE 2

| | | Heat Treatment | | | | | | | Tensile Property | | Variation in Tensile Property | | |
|---|---|---|---|---|---|---|---|---|---|---|---|---|---|
| | | Quenching | | | | | | | | | | | |
| | | | Cooling | | Cooling Facilities | | Tempering | Residual | Yield | Tensile | Yield | Tensile | |
| Steel Code | Steel Pipe Code | Heating Temperature (° C.) | Method | Cooling Stop Temperature (° C.) | Application | Cooling Stop Temperature (° C.) | Heating Temperature (° C.) | Austenite Fraction (%) | Strength YS (MPa) | Strength TS (MPa) | Strength YS±* (MPa) | Strength TS±** (MPa) | Note |
| A | A1 | 960 | Air Cooling | 45 | No | — | 705 | 0 | 677 | 828 | 34 | 41 | Conventional Example |
| B | B1 | 980 | Water Cooling | 45 | No | — | 600 | 6.7 | 949 | 1095 | 65 | 54 | Comparative Example |
| | B2 | 980 | Water Cooling | 45 | Yes | 10 | 600 | 4.9 | 989 | 1114 | 47 | 54 | Example |
| C | C1 | 980 | Water Cooling | 45 | No | — | 600 | 12 | 663 | 846 | 56 | 43 | Comparative Example |
| | C2 | 980 | Water Cooling | 45 | Yes | 10 | 600 | 10 | 700 | 846 | 35 | 44 | Example |
| D | D1 | 920 | Water Cooling | 45 | No | — | 580 | 2.9 | 691 | 902 | 57 | 46 | Comparative Example |
| | D2 | 920 | Water Cooling | 45 | Yes | 10 | 580 | 0.9 | 725 | 906 | 36 | 45 | Example |

Annotation
*Difference from Target Yield Strength
**Difference from Target Tensile Strength In our examples, variation in yield strength was smaller than in the comparative examples, which means that the problem of a variation in yield strength was significantly improved. In steel A which is a conventional example where the Cr content was as low as 12.4%, the Ms point was much higher than room temperature and 345° C. Therefore, when steel A was used, variations in tensile properties were small even when using the conventional heat treatment.

The invention claimed is:

1. A method of manufacturing a high strength stainless steel tube or pipe comprising using an online heat treatment equipment line for a seamless steel tube or pipe in which a heating furnace for quenching, equipment for quenching, and a tempering furnace are used in the lower process of a rolling line, arranging equipment for low-temperature cooling capable of cooling a heat treated steel tube or pipe to a temperature of 10° C. or lower between the equipment for quenching and the tempering furnace, and cooling the heat treated steel tube or pipe to a temperature of 10° C. or lower with the equipment for low-temperature cooling after quenching treatment and before a tempering treatment is performed.

2. The method according to claim 1, wherein the high strength stainless steel tube or pipe has a chemical composition containing, by mass %, C: 0.005% or more and 0.05% or less, Si: 0.05% or more and 1.0% or less, Mn: 0.2% or more and 1.8% or less, P: 0.03% or less, S: 0.005% or less, Cr: 14% or more and 20% or less, Ni: 1.5% or more and 10% or less, Mo: 1% or more and 5% or less, N: 0.15% or less, O: 0.006% or less, and the balance being Fe and inevitable impurities, and wherein the high strength stainless steel tube or pipe is reheated at a temperature of 850° C. or higher and 1000° C. or lower using the heating furnace for quenching, the reheated pipe is cooled to a temperature of 50° C. or lower at a cooling rate equal to or more than an air cooling rate using the equipment for quenching, the tube or pipe is subsequently cooled to a temperature of 10° C. or lower using the equipment for low-temperature cooling, and the cooled tube or pipe is heated at a temperature of 450° C. or higher and 700° C. or lower using the tempering furnace.

3. The method according to claim 2, wherein the high strength stainless steel tube or pipe has the chemical composition further containing, by mass %, one or more selected from among Al: 0.002% or more and 0.05% or less, Cu: 3.5% or less, Nb: 0.5% or less, V: 0.5% or less, Ti: 0.3% or less, Zr: 0.2% or less, W: 3% or less, B: 0.01% or less, Ca: 0.01% or less, and REM: 0.1% or less.

* * * * *